United States Patent [19]

Nakayama

[11] 4,330,999

[45] May 25, 1982

[54] REFRIGERANT COMPRESSOR

[75] Inventor: Shozo Nakayama, Kariya, Japan

[73] Assignee: Kabushiki Kaisha Toyoda Jidoshokki Seisakusho, Aichi, Japan

[21] Appl. No.: 202,726

[22] Filed: Oct. 31, 1980

Related U.S. Application Data

[63] Continuation of Ser. No. 922,730, Jul. 7, 1978, abandoned.

[30] Foreign Application Priority Data

Jul. 27, 1977 [JP] Japan ..... 52-100526
Jul. 27, 1977 [JP] Japan ..... 52-100527

[51] Int. Cl.[3] ..... F25B 31/00
[52] U.S. Cl. ..... 62/217; 417/295
[58] Field of Search ..... 62/217; 417/295; 137/625.31, 505.13; 251/301

[56] References Cited

U.S. PATENT DOCUMENTS

| | | | |
|---|---|---|---|
| 2,988,263 | 6/1961 | Fogt | 417/295 |
| 3,264,842 | 8/1966 | Dobbie | 417/295 X |
| 3,285,031 | 11/1966 | Matthies | 62/217 |
| 3,659,783 | 5/1972 | Schwartz | 62/217 X |
| 3,794,063 | 2/1974 | Carroll et al. | 62/217 X |
| 3,800,551 | 4/1974 | Weibel, Jr. et al. | 62/217 |
| 3,858,406 | 1/1975 | Izumi | 62/217 X |
| 3,858,407 | 1/1975 | Schumacher | 62/217 |
| 4,089,623 | 5/1978 | Hofmann, Jr. | 417/295 |
| 4,127,363 | 11/1978 | Kato et al. | 417/269 |

*Primary Examiner*—William E. Tapolcai, Jr.
*Attorney, Agent, or Firm*—Browdy and Neimark

[57] ABSTRACT

A refrigerant compressor which automatically adjusts the suction amount of the refrigerant gas according to the variation of the operative conditions of the refrigerating system. The compressor is provided with a detector (sensor) such as bellows, bimetals, etc., which are variable in form according to the variation of pressure or temperature of the refrigerant gas caused by the variation of operative conditions of the refrigerating system, and with a device which is actuated by the deformation or form-variation of the detector for varying the flow passage area of the refrigerant gas at the suction port of the refrigerant gas to the compressing chamber of the compressor.

14 Claims, 11 Drawing Figures

9
19
13
12
22
IV
2
20
19
27
17
21
18
10
11
3
1
7
6
5
15
4
18
17
20
III
8
27
13
11
12
10

10
25
24
26
21c
21b
18

10
21
21b
21a
22b
22
22a 104
103
105
102
107
108
101
100
106

REFRIGERANT COMPRESSOR

This is a continuation of application Ser. No. 922,730 filed July 7, 1978, abandoned.

BACKGROUND OF THE PRESENT INVENTION

The present invention relates to an improvement of the refrigerant compressor, more particularly, to a compressor automatically adjustable in the suction efficiency of the refrigerant gas by means of varying the flow passage area of the suction port of the refrigerant gas to the compressing chamber, in response to the load variation of the refrigerating system.

In a refrigerating system, an expansion valve is generally installed between a condensor and an evaporator, which is adjusted in the degree of opening according to the load variation, for controlling the flow amount of the refrigerant. When the load is decreased and the expansion valve is choked excessively, however, the inner pressure in the evaporator is liable to be lowered too much, which excessively lowers the temperature in the evaporator to induce freezing on the outer wall of the evaporator, resulting in obstructing the flow of the air-to-be-cooled. In order to prevent this undesirable phenomenon, attempts have been conventionally made, one being (1) a method of releasing the clutch disposed between the compressor and the driving source, when the temperature of the air which passes the evaporator has come down to a certain value; and another being (2) a method of disposing an evaporating-pressure-adjusting-valve at the outlet port of the evaporator for preventing the pressure descending in the evaporator below a certain value. The former is defective in the short life of the clutch due to too high frequency of "on-off" operation of the same, and a rapid increase of load to the driving source at every clutch connection. Especially when the refrigerant compressor is in use for vehicle airconditioning, the engine load of the vehicle is rapidly increased to cause a disagreeable drive-feeling. The latter, which is not affected by the on-off of the clutch, is also unsatisfactory in the positioning of the evaporating-pressure-adjusting-valve at the outlet port of the evaporator. When the valve is choked, because of a low load, in the piping from the valve to the compressor as well as in the suction chamber and other vacant chambers in the compressor, the refrigerant pressure from there to the compressor will come down to an extremely low level, which lowers the temperature of the refrigerant to increase the temperature difference against the piping and compressor (a refrigerant which shows the temperature 5°–10° C. at the pressure 2 atg. will be lowered in temperature to −15°–−20° C. as the pressure descends down to 0.5 atg.). The greater the temperature difference becomes, the more useless heat absorption takes place by the refrigerant from the atmosphere around the piping; in addition, the heat which ought to be dispersed into the atmosphere from the compressor will be unfavorably absorbed by the refrigerant. This not only reduces the efficiency of the refrigerating cycle, but also brings about a rising of the superheat of the refrigerant (temperature rising exceeding the saturation temperature), which is liable to result in a seizure of the compressor. When the refrigerant, which is already heated to a super-heat having absorbed a large amount of heat before being sucked into the compressing chamber, is compressed in the compressor, its temperature becomes higher than usual.

A refrigerant showing 5° C. at the pressure 1.5 atg. just before the suction valve of the compressor will be, when compressed in the compressor up to 15 atg., heated to 80° C., while a refrigerant showing 0° C., having absorbed a relatively large heat amount, under the pressure of 0.5 atg. will be, when compressed up to 15 atg., heated up to about 90° C. The temperature rise in the discharged gas will, via the blow-by gas, heat excessively each sliding portion, and is liable to result in a seizure of the compressor. The temperature, rise, furthermore, causes the excessive heat of the compressing chamber and its vicinities as well as discharging chamber, while the suction side, such as a passage, a suction chamber, and its environments, is maintained in low temperature cooled by the refrigerant which is colder than usual. This will cause a great temperature difference between the suction side and the discharge side, which is likely to cause a strain or deformation in the compressor, especially in an aluminum compressor used for weight reduction.

SUMMARY OF THE PRESENT INVENTION

The present invention has been made from such a background.

It is therefore a primary object of this invention to provide a refrigerant compressor capable of automatically preventing an excessive descending of the temperature in the evaporator when the load is lowered in the refrigerating system.

It is another object of this invention to provide a refrigerant compressor, wherein the flow passage area, to the compressing chamber, of the suction port of the refrigerant can be automatically adjusted, according to the operative conditions of the refrigerating system, such that the suction efficiency is to be matched to the operative conditions of the refrigerant system.

It is still another object of this invention to provide a refrigerant compressor capable of automatically choking or throttling the flow passage area of the suction port of the refrigerant, having detected the pressure decrease in the refrigerant when the expansion valve for the refrigerant is choked due to a load decrease of the refrigerating system.

It is a further object of this invention to provide a refrigerant compressor capable of automatically choking or throttling the flow passage area of the suction port of the refrigerant, having detected the temperature decrease in the refrigerant when the temperature of the refrigerant is lowered due to a load decrease of the refrigerating system.

It is a still further object of this invention to provide a refrigerant compressor, wherein the flow passage area of the suction port is varied by a suction-opening-regulating-plate disposed at the suction port in order to maintain the pressure of the refrigerant at a comparatively high value up to immediately before the suction port, even under a low load, by means of a device that enables the suction-opening-regulating-plate to be moved by a bellows which is expanded-or-contracted by the pressure variation of the refrigerant, or by a bimetal which is deformed by the temperature variation of the refrigerant.

It is a still further object of this invention to provide a refrigerant compressor, wherein the lift amount of the suction valve is regulated, by a movable stopper which is moved due to temperature or pressure variation of the refrigerant, in order to maintain the pressure of the refrigerant at a comparatively high value up to immediately before the suction valve, even under a low load.

It is also an object of this invention to attain all of the above-mentioned objects without complicating the structure of the compressor nor increasing the manufacturing cost thereof.

In a refrigerant compressor in accordance with this invention, the flow passage area of the refrigerant at the suction port is, when the load of refrigerating system including the compressor is decreased, automatically reduced to lower the suction efficiency of the compressor, which serves to prevent an excessive temperature decrease of the evaporator in the refrigerating system even under a low load condition, without being affected by the frequent on-off operation of the clutch in question or employing an evaporating-pressure-adjusting valve. Besides, the refrigerant can be maintained at a certain pressure or more until immediate before being sucked into the compressing chamber, which effectively prevents the temperature falling and consequently prevents useless heat absorption from the piping up to the compressor or the inside passage and wall of the compressor. It improves the operation efficiency of the refrigerating circuit as a whole. Furthermore, the refrigerant finally expands at the moment of being sucked, accompanied by a falling of temperature, which effectively restricts the rising of the superheat degree, resulting in holding-down of the maximum temperature after the compression at a lower level than in the conventional machine. It is quite effective in restraining the temperature rise in the vicinity of the compressing chamber and the discharging chamber, and in preventing the seizure in question. As can be understood from the above description, the decrease of the temperature falling in the vicinity of the refrigerant suction passage and the temperature falling in the vicinity of the compressing chamber greatly serve to reduce the temperature difference between the two, being a substantial improvement in comparison to the prior art.

Other objects and advantages will be apparent to those skilled in the art from the following description of some specific embodiments of the inventive principles that will thereafter be pointed out in the claims.

DETAILED DESCRIPTION OF THE PREFERRED EMBODIMENTS

Figure 1:
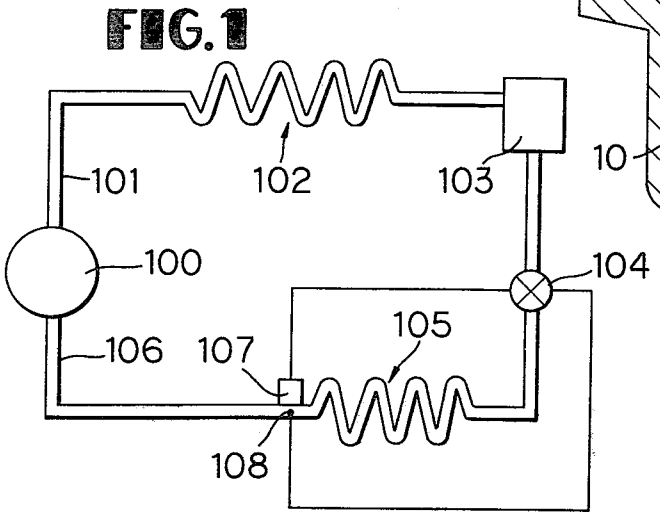
FIG. 1 is a schematic outline of a refrigerating system incorporating the invention refrigerant compressor.

FIG. 1 is a schematic illustration of a refrigerating system, including a refrigerant compressor of this invention, for vehicle use, in which 100 designates a swash-plate type refrigerant compressor (hereinafter may be called compressor). The refrigerant compressed, in this compressor 100, up to high pressure and high temperature is delivered, via piping 101, to a condenser 102 for being cooled into a liquid, to be reserved in a reservoir 103. The refrigerant in the reservoir 103 is led through an expansion valve 104 to an evaporator 105, wherein the refrigerant takes the heat from the atmosphere to cool the same while being evaporated into a gas state to be sucked, via piping 106, into the compressor 100 for being compressed again therein. The degree of opening of the expansion valve 104 is automatically adjusted by the signals from a pressure gage 107 and a thermometer 108 disposed at the outlet of the evaporator 105.

Figure 2:
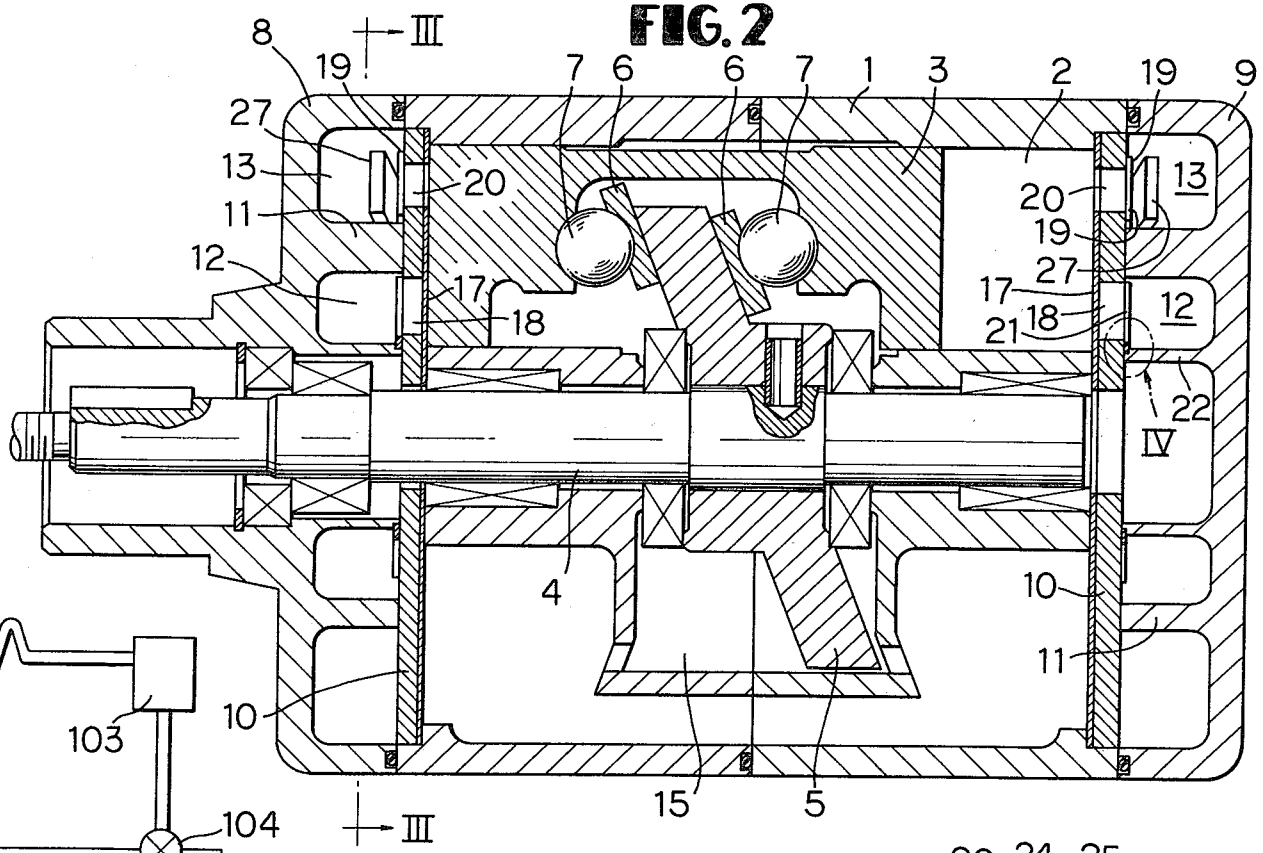
FIG. 2 is an elevational cross-section view of a first embodiment of a swash-plate type refrigerant compressor of this invention.
Figure 4:
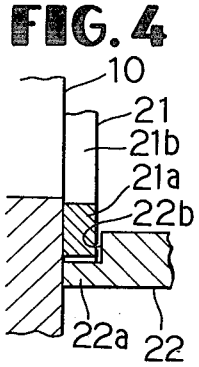
FIG. 4 is an enlargement of the IV portion of FIG. 2.
Figure 3:
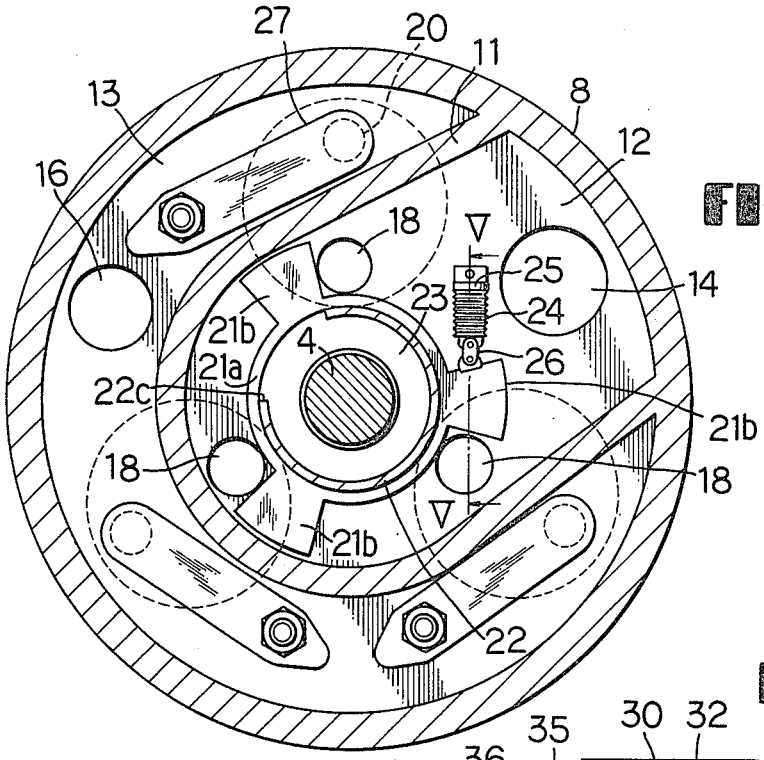
FIG. 3 is a transverse cross-section of FIG. 2 taken along the section line III—III.

The compressor is illustrated in detail in FIGS. 2 and 3, in which 1 designates a cylinder block, and a plurality of cylinder bores 2 formed therein respectively accommodates a slidable piston 3. The piston 3 is driven, via shoe 6 and a ball 7, by a swash-plate 5 which is slantwise fixed on a shaft 4 with a certain predetermined angle and rotated therewith. The cylinder block 1 is, on either end, covered by a front housing 8 and a rear housing 9. Between the cylinder block 1 and each housing 8, 9 is retained a valve plate 10 respectively. A space formed on either side of the compressor between the housing 8, 9 and the valve plate 10 is separated, with a secluding wall 11 integrally formed with the housing 8, 9, into a suction chamber 12 and a discharge chamber 13. Two of the suction chambers 12 on either side of the cylinder block 1 are connected by a suction passage 14 formed through the cylinder block 1, which passage is also communicated with the piping 106 from the evaporator 105 as well as a swash-plate chamber 15. Two of the discharge chambers 13 are similarly connected by a discharge passage 16 formed through the cylinder block 1, and communicated with a piping 101 to the condenser 102. In the valve plate 10 is formed a suction port 18 having a suction valve 17 at the place secluding the suction chamber 12 from the cylinder bore 2; a discharge port 20 having a discharge valve 19 is formed in a similar way at the place secluding the discharge chamber 13 from the cylinder bore 2. The lift amount of the discharge valve 19 is regulated by a stopper 27. The suction port 18 is, according to this invention, provided with a suction-opening-regulating-plate 21 (hereinafter called a regulating plate), which is composed of an annular plate portion **21*a* and a plurality (in this embodiment three in number) of sheltering (or covering) portions 21*b* radially arranged, on the periphery of the annular plate portion 21*a*, with a similar circumferential angular distance, the entirety of which is rotatably fitted on a boss 22, which protrudes from the inner side, concentrically in the central portion, of the housing 8, 9. The end portion of the boss 22 is, as shown in FIG. 4 in enlargement, provided with a stepped portion 22*a*, i.e., a portion where the wall width is reduced; and the regulating plate 21 is rotatably fitted on this stopped portion 22*a*, being sandwiched between a shouldered portion 22*b* and the valve plate 10 with a small gap left there. And the boss 22 has a recess 22*c* (or a cut away portion), which communicates a vacant space 23 within the boss 22 with the suction chamber 12**.

Figure 5:
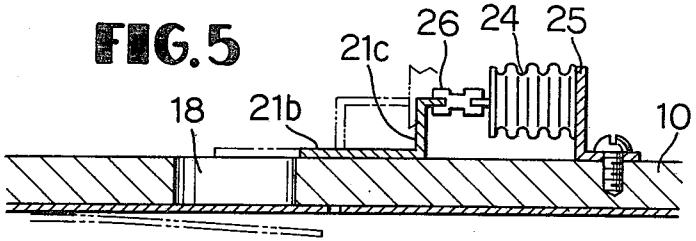
FIG. 5 is a cross-sectional view of FIG. 3 taken along the section line V—V.

The regulating plate 21 is actuated by a bellows, which is expanded and contracted according to pressure variations in the suction chamber 12. As shown in FIG. 5, one end of the bellows 24 is firmly attached on a bracket 25 which is fixed on the valve plate 10, the other end being, via a link 26, connected to a connecting portion 21*c* of the regulating plate 21. As a gas under a predetermined pressure (including vacuum) is sealed up within the bellows 24, increasing or decreasing of the refrigerant pressure in the suction chamber 12, which surrounds the bellows 24, makes the same contract or expand, which in turn rotates the regulating plate 21. This rotation movement of the regulating plate 21, with its sheltering portions, 2 lb, varies the degree of opening of the suction ports 18 according to the extent of the covering over the openings. The relationship between the pressure variation in the suction chamber 12 and the variation of the area of the suction port opening can be adjusted comparatively easily by means of varying the spring constant of the bellows 24; it can be, if necessary, further varied by free choice of the configurations of either or both of the sheltering portions 21*b* and the suction ports 18.

In a refrigerating system including a compressor 100 of this construction, when the load is large, i.e., the suction pressure of the compressor 100 is high, the bellows 24 is in contraction, leaving the sheltering portions 21*b* of the regulating plate 21 clear of the suction ports 18, that is to say, the latter being left completely open.

When, on the contrary, the expansion valve 104 in the refrigerating system is choked to lower the suction pressure of the compressor 100, the bellows 24 is expanded to rotate the regulating plate 21 in clockwise direction, in FIG. 3, rendering the sheltering portions 21*b* partly covering the suction ports 18. This automatic reduction of the opening area of the suction port 18 lowers the suction efficiency of the compressor 100, bringing about a decrease of work amount in the compression process, and in turn, reduction of required motive power.

When the flow amount of the refrigerant is reduced, in this embodiment, the flow of the same is choked immediately before entering the cylinder bore 2, so pressure lowering of the refrigerant exceeding a certain limit can be prevented not only in the evaporator 105 but also in the piping 106 between the evaporator 105 and the compressor 100, the swash-plate chamber 15, the suction passage 14, and the suction chamber 12. In the prior art wherein the evaporating-pressure-adjusting-valve is installed at the outlet of the evaporator, the refrigerant expands soon after it passes the evaporating-pressure-adjusting-valve, when the flow amount of the refrigerant is reduced, becoming lower in its temperature before entering the compressor. In this embodiment, the refrigerant, contrary to this prior art, keeps its pressure above a predetermined value, accompanied by the maintenance of the temperature higher than in the prior art, restricting the heat absorption lesser from the piping 106, the suction passage 14, etc. This produces an improvement of the operation coefficient of the refrigerating machine as a whole. Since the refrigerant finally expands its volume after having passed the suction port 18, which opening is throttled by the regulating plate 21, accompanied by the rapid descending of the temperature, it effectively cools the wall of the cylinder bore 2 and prevents, being kept in comparatively low temperature, the overheating of the cylinder bore 2 and its vicinity where the temperature is liable to rise. As described above in detail, the compressor of this embodiment is generally held down in its temperature rising and mitigated in its temperature difference, between the high temperature portion and the low temperature portion, which is largely effective in the prevention of seizure and deformation by heat. The temperature falling in the swash-plate chamber 13, because of the temperature decrease of the blow-by gas, from the cylinder bore 2 to the swash-plate chamber 13, due to the maintenance of the superheat in low level, and of the heat amount decrease delivered by conduction from the cylinder block 1 and the piston 3 to the swash-plate chamber 13, is also one of the favorable phenomena for seizure prevention.

Another merit of this embodiment lies in that the refrigerant pressure is kept almost unchanged in the low pressure circuit, because the expanded bellows favorably lowers the suction efficiency of the compressor, contrary to the conventional common knowledge that the refigerant pressure naturally falls down on the suction side when the number of rotations of the compressor increases (rise of engine RPM) under the same load.

Figure 6:
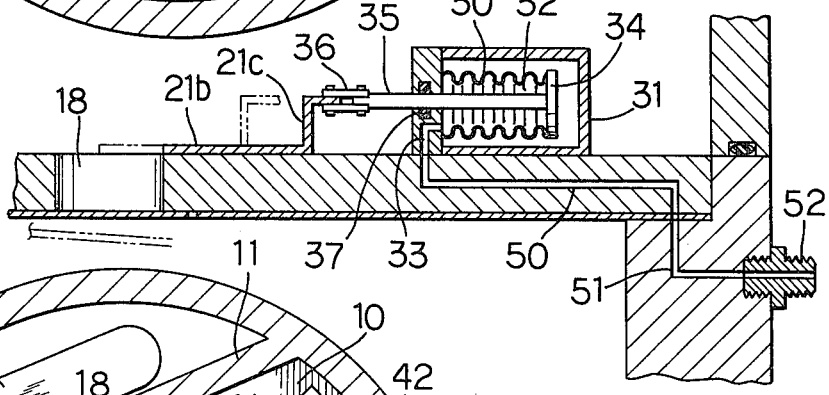
FIG. 6 is a similar cross-sectional view to FIG. 5 of a second embodiment of a refrigerant compressor of this invention.

In a second embodiment shown in FIG. 6, the bellows 30 is confined in a gas-tight sealed container 31, inside of which is a vacuum while the inside chamber 32 of the bellows 30 is communicated with the evaporator 105 (refer to FIG. 1), via pipings 33, 50, 51 and a connector 52, and through a not-shown outer piping. Thus the bellows 30 is expanded, when the inside pressure of the evaporator 105 is increased, and contracted when the same is lowered. On a bottom plate 34 of the bellows 30 is secured a rod 35, which is led through the container 31 outside. The end of the rod 35 is connected, via a link 36, to a connecting portion 21*c* of the regulating plate 21. The rod 35 is slidable in the axial direction relative to the container 31, gas-tightness between both being held by an O ring 37.

When the load to the refrigerating system is large, i.e., the evaporator 105 is in high pressure, the bellows 30 is expanded, rendering the sheltering portion 21*b* of the regulating plate 21 offset from the suction port 18, as shown in FIG. 6 with a solid line, leaving the suction port 18 completely open. When the evaporator 105 is in low pressure, due to a decrease of load to the refrigerating system, the bellows 30 is contracted to rotate the regulating plate 21 up to a position, shown in FIG. 6 with a two-dot-chain line, and the suction port 18 will be partly covered by the sheltering portion 21*b*. The flow of the refrigerant is throttled here to maintain its pressure above a certain predetermined value, even when the flow amount is small, in the circuit before passing the regulating plate 21, which results in the attainment of the object of this invention.

The communication of the inside chamber 32 in the bellows 30 with the evaporator 105, in this embodiment, is aimed at preventing lowering of the refrigerant flow amount at the initial operation time for avoiding lubrication shortage. Because, the earlier mentioned method of expand- and contracting the bellows 24 by means of the inside pressure of the suction chamber 12 is advantageous in not imparting a sudden fluctuation of load to the engine at the initial compression time (which is desirable in keeping the driving feeling agreeable), due to a momentary drop of the suction efficiency, caused by the transitory pressure drop in the suction chamber 12 at the initial compression time followed by a rotation of the regulating plate 21 to the closing direction; however, it is not necessarily preferable in case of employing lubrication oil, for the lubrication of the compressor, which circulates with the refrigerant, as the decrease of the refrigerant flow amount tends to cause a lubrication shortage. In such a case, the communication of the inside chamber 32 of the bellows 30, not to the suction chamber 12, but to the evaporator 105, wherein the pressure drops soon after the initial operation is small and the pressure level is recovered quickly, is recommended.

Figure 7:
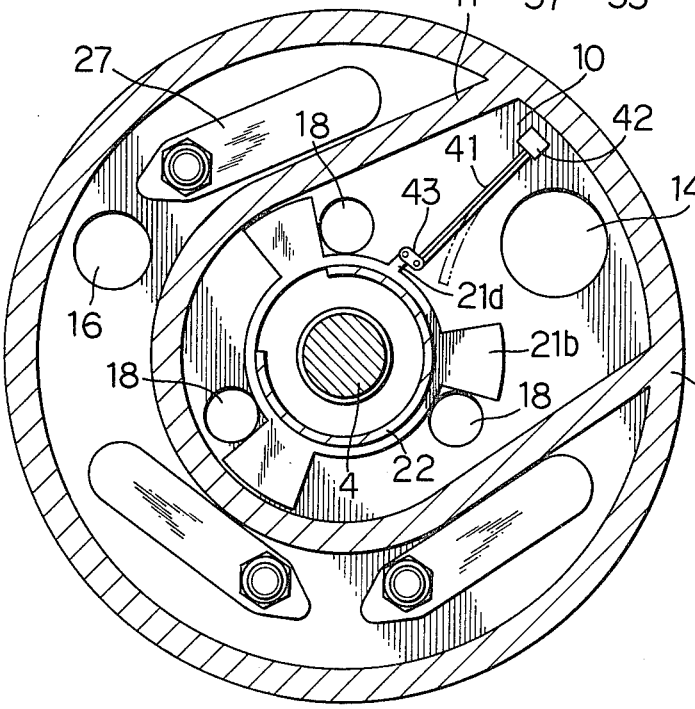
FIG. 7 is a similar transverse cross-sectional view to FIG. 3 of a third embodiment of a swash-plate type refrigerant compressor of this invention.

In a third embodiment, shown in FIG. 7, a bimetal senses (detects) lowering of the refrigerant temperature due to decreasing of the load to the refrigerating system, and thereby actuates the regulating plate 21.

A bimetal 41 is, at one end thereof, attached to the valve plate 10 with a bracket 42, the other end thereof being connected, via a link 43, to a connecting lug **21*d* of the regulating plate 21. The bimetal 41 senses the temperature variation of the refrigerant coming from the suction passage 14 and bends correspondingly, in a parallel direction to the surface of the valve plate 10, in order to rotate the regulating plate 21**.

When the load of the refrigerating machine is great and the temperature of the refrigerant-to-be-sucked by the compressor is high, the bimetal 41 and the regulating plate 21 remain in the state shown with a solid line in FIG. 7, and the suction port 18 is left fully open. When the load of the refrigerating system is decreased to throttle the expansion valve, accompanied by the pressure falling of the inside at the evaporator, the temperature of the refrigerant to be sucked by the compressor descends, followed by the bending of the bimetal 41 in the direction shown with a two-dot-chain line in FIG. 7. Consequently, the regulating plate 21 is rotated in the clockwise direction, in FIG. 7, letting the sheltering portion **21*b* partly shut (cover) the suction port 18 for choking the refrigerant flow. This keeps the pressure of the refrigerant, even when the flow amount of the refrigerant is small, above a predetermined value in the circuit before the regulating plate 21**. The object of this invention can be attained in this way. In those embodiments mentioned above, a particular regulating plate installed at the suction port varies the flow passage area of the suction port. The same object can be, however, attained by a movable stopper shiftable according to the variation of the temperature and pressure of the refrigerant, for regulating the lift amount of the suction valve. Some of the examples will be disclosed hereunder.

Figure 8:
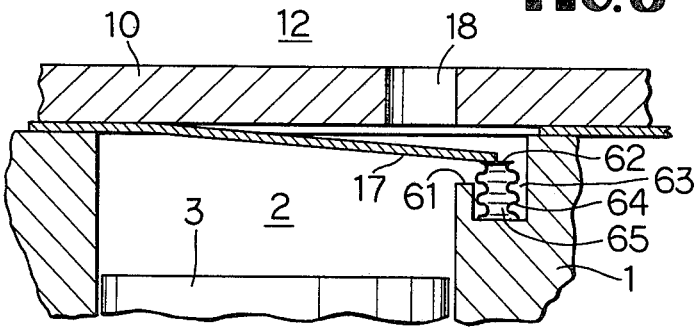
FIGS. 8, 9, 10, and 11 are respectively a similar cross-sectional view to FIG. 5 of different embodiments of a swash-plate type refrigerant compressor of this invention.

In FIG. 8, a fourth embodiment, a suction valve 17 is regulated by both a fixed stopper 61 and a movable stopper 62 in accordance with this invention, the latter being formed as a top surface of a bellows 64 mounted on the cylinder block 1 in a recessed portion 63 thereof just at a confronted position with the tip of the suction valve 17. The bellows 64 contains in its inside chamber 65 a gas of predetermined pressure (including vacuum) sealed up therein, and expands and contracts substantially in a similar direction to that of the open-and-close movement of the suction valve 17, according to the inside pressure of the cylinder bore 2 and the reaction force from the suction valve 17. The amount of expansion and contraction of the bellows 64 can be varied freely by changing the spring constant thereof.

In a refrigerating system (for a vehicle air-conditioning circuit) including a compressor of above-mentioned construction, when the load is increased to heighten the suction pressure of the compressor, the bellows 64 is in contraction below the fixed stopper 61, allowing the suction valve 17 to be regulated by the fixed stopper 61 in the similar way to the conventional art.

When the load is reduced, in the running, to throttle the expansion valve followed by the descending of the suction pressure of the compressor, the bellows 64 is expanded to elevate the top surface thereof higher than the tip of the fixed stopper 61. The lift amount of the suction valve 17 is regulated smaller by the movable stopper 62 than by the fixed stopper 61. This brings about a reduction of suction efficiency of the compressor, and consequently reduces the working amount of the compressing process followed by the reduction of required motive force, for preventing an excessive falling of the inside temperature of the evaporator.

Figure 9:
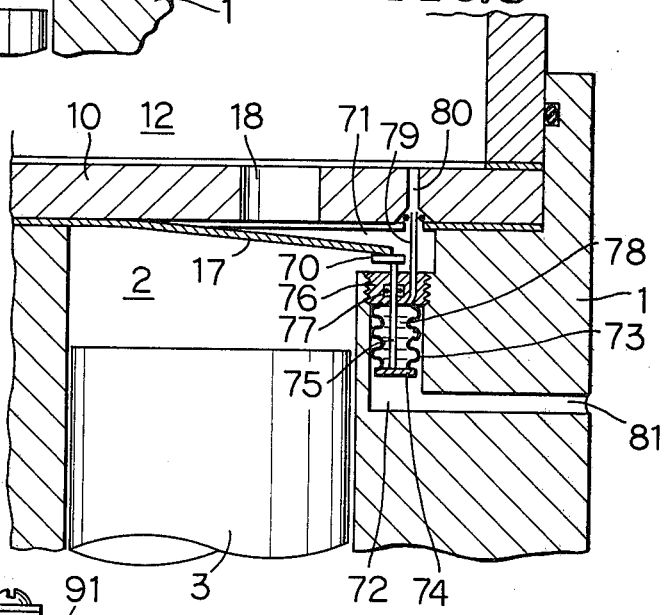

In a fifth embodiment, shown in FIG. 9, a movable stopper 70 is mounted in a recessed portion 71, at a confronted position with the tip of the suction valve 17, being adjustable of its position by a bellows 73 disposed in a vacant space 72 formed in the cylinder block 1. Movable stopper 71 is attached to the tip of a rod 75 placed on a bottom plate 74 of the bellows 73, which rod 75 projects into the recessed portion 71, piercing through the base portion 76 of the bellows 73, threaded into the space 72. The rod 75 is slidable through, and axially in relation to, the base portion 76 of the bellows 73, the gas-tightness between the two being held by an O ring 77. The inside chamber 78 of the bellows 73 is, via a passage 79 and another passage 80, communicated with the suction chamber 12 and outside hollow place surrounding the bellows 75 is, via a passage 81, connected to the ambient atmosphere.

When the load of the refrigerating system is great and the pressure of the suction chamber 12 is high, the bellows 73 is expanded to maintain the movable stopper 70 at the most retracted position, functioning similarly to the conventional fixed stopper. When the load of the refrigerating system is, on the contrary, decreased to lower the pressure of the suction chamber 12, the pressure of the inside vacant chamber 78 of the bellows 73 is also lowered, allowing the bellows 73 to contract, due to an increase of the pressure difference with the vacant space 72 outside the bellows 73, which is constantly held at atmospheric pressure, down to the position where the pressure difference is balanced with the spring force of the bellows 73. The rod 75 projects into the recessed portion 71 by the same amount as the bellows' contraction to move the movable stopper 70 towards the valve plate 10. The lift amount of the suction valve 17 is regulated smaller in comparison to the case where the load of the refrigerating system is great, which is also a way of attaining the object of this invention.

Figure 10:
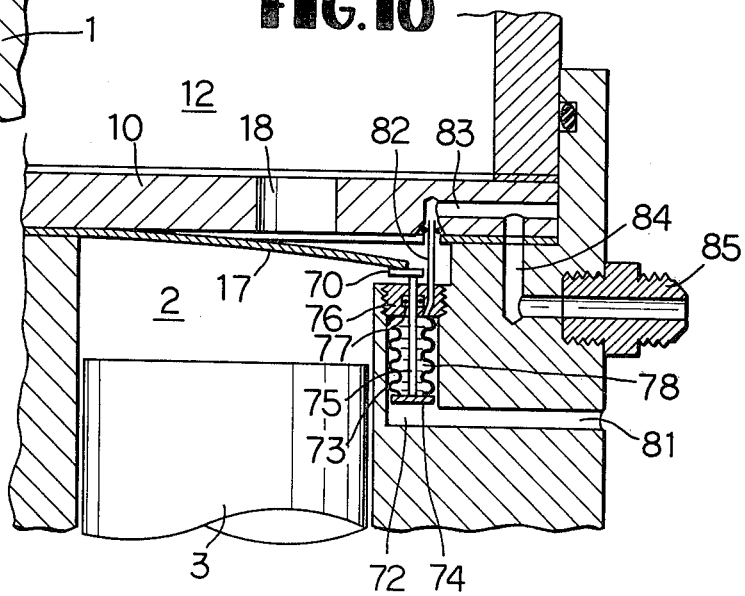

Contrary to the way of communication, in this embodiment, between the inside chamber 78 of the bellows 73 and the suction chamber 12, another way of communication is recommendable, in a case in which the lubrication of the compressor employs lubrication oil which circulates with the refrigerant, wherein the inside chamber 78 of the bellows 73 is, as shown in FIG. 10 as a sixth embodiment, connected to an evaporator 105 (in FIG. 1) etc. which is less in pressure falling soon after the initial operation and fast in restoration thereof, via passages 82, 83, 84, and a connector 85, and further through a not-shown outer piping.

Figure 11:
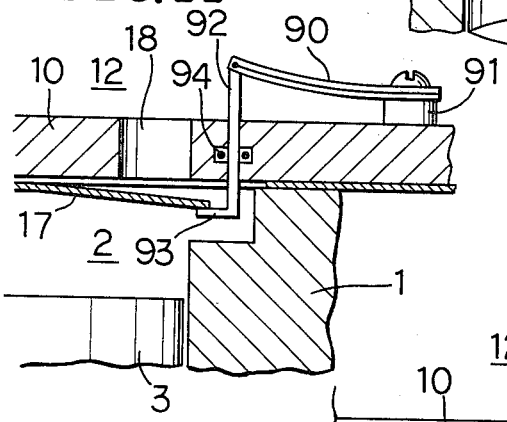

A seventh embodiment shown in FIG. 11 is provided with a bimetal, which senses the temperature falling of the refrigerant to be sucked into the compressor, for regulating the lift amount of the suction valve. A bimetal 90 is, via an attaching seat 91 made of comparatively low heat conductive material such as resin, secured to, at one end thereof, the valve plate 10, the other end thereof being pivoted to a rod 92, which is, piercing the valve plate 10, projected into the cylinder bore 2 and is attached on the tip thereof to a movable stopper 93. The rod 92 is slidable in relation to the valve plate 10, the gas-tightness between the two being secured by an O ring 94.

When the temperature of the refrigerant is decreased due to load reduction in the refrigerating system, the bimetal 90 is, as shown in FIG. 11, bent upwards to draw the movable stopper 93 closer to the valve plate 10, regulating the lift amount of the suction valve 17 to be small, followed by the reduction of the suction efficiency of the compressor. This is also a way of attaining the object of this invention.

The above description is limited to the way of diminishing the flow passage area at the suction port for preventing an excessive temperature falling in the evaporator under a low load condition of the refrigerating system. In a case wherein the load is extremely low, however, the conventional way of disconnecting the electromagnetic clutch of the compressor is practicable, by means of limiting the choking degree of the flow passage area, in order to allow the fall of the evaporator pressure below a predetermined value and to detect the resultant temperature falling as a signal to the clutch to cause its disconnecting.

This invention is not limited, in its application, to the swash-plate type compressors, but is widely usable in any other type of refrigerant compressors with almost the same effects.

What is claimed is:

1. A refrigerant compressor for a refrigerating system including an evaporator comprising:

at least one compressing chamber;

a compressing mechanism for compressing the refrigerant by means of varying the capacity of said compressing chamber;

a suction valve having a valve port and a valve element for sucking the refrigerant into said compressing chamber;

a discharge valve for discharging the refrigerant from said compressing chamber;

a sensing member deformable due to lowering of the suction pressure of the refrigerant caused by the variation of the operative condition of said refrigerating system; and control means, installed within said compressor and actuated by the deformation of said sensing member, for reducing the flow passage area for the refrigerant at the valve port of said suction valve in response to the suction pressure lowering to reduce automatically the suction amount of the refrigerant to said compressing chamber for preventing excessive lowering of the temperature in the evaporator to induce the frosting on the outer surface of said evaporator, while the pressure of the refrigerant is maintained high immediately upstream, and decreased at, the valve port of said suction valve, whereby the refrigerant is prevented from uselessly absorbing heat owing to temperature lowering caused by expansion thereof.

2. A refrigerant compressor in accordance with claim 1, wherein said control means is a regulating plate for an opening of the valve port of said suction valve forming a through bore, said regulating plate being slidable over the periphery of said opening for reducing the area of the opening of said through bore.

3. A refrigerant compressor in accordance with claim 1, wherein said control means is composed of the valve element of said suction valve and a movable stopper, which is to be shifted by the deformation of said sensing member, for regulating the lift amount of said valve element.

4. A swash plate type refrigerant compressor for a vehicle air conditioner comprising:

a cylinder block having a plurality of cylinder bores formed parallel to each other;

a plurality of pistons individually disposed in each of said cylinder bores;

a swash plate secured slantwise to and rotated by a rotary shaft for reciprocating each of said pistons within said cylinder bores;

a suction valve having a valve port and a valve element for sucking the refrigerant to each of said cylinder bores;

a discharge valve for discharging the refrigerant from each of said cylinder bores;

a bellows disposed in the vicinity of the valve port of said suction valve and containing therein a sealed-up gas of constant pressure, including vacuum, for expanding in response to lowering of the suction pressure of the refrigerant; and a regulating plate for an opening of the valve port of said suction valve forming a through bore, said regulating plate being installed within said compressor slidably over the periphery of said opening and connected to said bellows for reducing the area of the opening of said through bore in response to the suction pressure lowering to automatically reduce the suction amount of the refrigerant to said cylinder bores for preventing excessive lowering of the temperature in said air conditioner to induce the frosting, while the pressure of the refrigerant is maintained high immediately upstream, and decreased at, the valve port of said suction valve, whereby the refrigerant is prevented from uselessly absorbing heat owing to temperature lowering caused by expansion thereof.

5. A refrigerant compressor for a refrigerating system including an evaporator comprising:

at least one compressing chamber;

a compressing mechanism for compressing the refrigerant by means of varying the capacity of said compressing chamber;

a suction valve having a valve port and a valve element for sucking the refrigerant into said compressing chamber;

a discharge valve for discharging the refrigerant from said compressing chamber;

a sensing member deformable due to lowering of the suction pressure of the refrigerant caused by the variation of the operative condition of said refrigerating system; and a regulating plate for an opening of the valve port of said suction valve forming a through bore, said regulating plate being installed within said compressor slidably over the periphery of said opening and actuated by the deformation of said sensing member for reducing the area of the opening of said through bore in response to the suction pressure lowering to automatically reduce the suction amount of the refrigerant to said compressing chamber for preventing excessive lowering of the temperature in the evaporator to induce the frosting on the outer surface of said evaporator, while the pressure of the refrigerant is maintained high immediately upstream, and decreased at, the valve port of said suction valve, whereby the refrigerant is prevented from uselessly absorbing heat owing to temperature lowering caused by expansion thereof.

6. A refrigerant compressor in accordance with claim 5, wherein said sensing member is a bellows which is expanded and contracted by the variation of the pressure difference between the inside pressure and the outside pressure surrounding the same.

7. A refrigerant compressor in accordance with claim 6 or claim 4, wherein said bellows contains therein a sealed up gas of constant pressure, including vacuum, and is actuated by the pressure of the ambient refrigerant immediately before said suction valve.

8. A refrigerant compressor in accordance with claim 6, wherein said bellows is actuated by being fed the pressure of the refrigerant in the evaporator of said refrigerating system into the inside chamber thereof, and being under a constant pressure in the gas-tightly sealed container enveloping said bellows.

9. A refrigerant compressor for a refrigerating system including an evaporator comprising:

at least one compressing chamber;

a compressing mechanism for compressing the refrigerant by means of varying the capacity of said compressing chamber;

a suction valve having a valve port and a valve element for sucking the refrigerant into said compressing chamber;

a discharge valve for discharging the refrigerant from said compressing chamber;

a sensing member deformable due to lowering of the suction pressure of the refrigerant caused by the variation suction pressure of the refrigerant caused by the variation of the operative condition of said refrigerating system; and a movable stopper installed within said compressor and shifted by the deformation of said sensing member, for regulating the lift amount of said valve element to reduce the flow passage area for the refrigerant at said suction valve in response to the suction pressure lowering with a result of automatic reduction of the suction amount of the refrigerant to said compressing chamber for preventing excessive lowering of the temperature in the evaporator to induce the frosting on the outer surface of said evaporator, while the pressure of the refrigerant is maintained high immediately upstream, and decreased at, said suction valve, whereby the refrigerant is prevented from uselessly absorbing heat owing to temperature lowering caused by expansion thereof.

10. A refrigerant compressor in accordance with claim 5 or 4 wherein said compressing chamber is a plurality of cylinder bores formed parallelly to each other within a cylinder block, and said compressing mechanism is composed of a respective piston disposed in each of said cylinder bores and a swash-plate secured slantwise to and rotatable with a rotary shaft for reciprocating said respective piston within a respective bore of said cylinder bores.

11. A refrigerant compressor in accordance with claim 9, wherein said sensing member is a bellows which is expanded and contracted by the variation of the pressure difference between the inside pressure and the outside pressure surrounding the same.

12. A refrigerant compressor in accordance with claim 11, wherein said bellows is actuated by being fed the pressure of the refrigerant immediate before said suction port into the inside chamber thereof, and by being under the atmospheric pressure at the outer side thereof.

13. A refrigerant compressor in accordance with claim 11, wherein said bellows is actuated by being fed the pressure of the refrigerant in the evaporator of said refrigerating system into the inside chamber thereof, and by being under the atmospheric pressure at the outside thereof.

14. A refrigerant compressor in accordance with claim 9 wherein the valve element of said suction valve is a leaf valve and said movable stopper is adapted to abut a free end of said leaf valve for restricting movement amount thereof.

* * * * *